US007962081B2

(12) United States Patent
Russel et al.

(10) Patent No.: US 7,962,081 B2
(45) Date of Patent: Jun. 14, 2011

(54) SYSTEMS AND METHODS FOR MONITORING A FUSER CLEANING WEB

(75) Inventors: Steven M Russel, East Bloomfield, NY (US); Stephen B Williams, Marion, NY (US); Richard E Eisemann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 310 days.

(21) Appl. No.: 12/241,488

(22) Filed: Sep. 30, 2008

(65) Prior Publication Data

US 2010/0080633 A1 Apr. 1, 2010

(51) Int. Cl.
*G03G 15/20* (2006.01)

(52) U.S. Cl. ..... 399/325; 399/326; 399/327

(58) Field of Classification Search ..... 399/325, 399/326, 327
See application file for complete search history.

(56) References Cited

U.S. PATENT DOCUMENTS

| | | | | |
|---|---|---|---|---|
| 4,396,275 | A * | 8/1983 | Oka et al. | 399/160 |
| 5,049,944 | A | 9/1991 | DeBolt et al. | |
| 5,797,063 | A * | 8/1998 | Umezawa et al. | 399/352 |
| 5,970,281 | A * | 10/1999 | Park | 399/352 |
| 6,876,832 | B2 | 4/2005 | Pirwitz et al. | |
| 2001/0049920 | A1 * | 12/2001 | Yamamoto et al. | 53/51 |
| 2002/0154926 | A1 * | 10/2002 | Katoh | 399/327 |
| 2007/0258739 | A1 * | 11/2007 | Ide et al. | 399/327 |

FOREIGN PATENT DOCUMENTS

| | | | |
|---|---|---|---|
| JP | 05173443 A | * | 7/1993 |
| JP | 2008139787 A | * | 6/2008 |

OTHER PUBLICATIONS

JP 2008139787 A to Izumikawa, English Abstract.*
JP 05173443 A to Maeda, English Abstract.*

* cited by examiner

*Primary Examiner* — Ryan D Walsh
(74) *Attorney, Agent, or Firm* — Richard A. Castellano; Prass LLP

(57) ABSTRACT

There is disclosed an improved fuser cleaning system in which a strip of flexible material, including first second and third portions, is fed from a source roll to a take-up roll in such a manner that a fuser roll is cleaned or oiled. A first detectable mark may be disposed on a side of the strip of flexible material in one of the first and second portions. During operation of the fuser cleaning system, the third portion is taken up by the take-up roll and when an amount of the third portion is taken up by the take-up roll, the first detectable mark is detected by a sensor and a signal, indicating that the amount of the third portion has been taken up by the take-up roll, is transmitted to a controller. A second detectable mark may be disposed on the side of the strip of flexible material. When substantially all of the third portion has been taken up by the take-up roll, a signal is transmitted from the sensor to the controller indicating that substantially all of the third portion has been taken up by the take-up roll.

20 Claims, 4 Drawing Sheets

| | |
|---|---|
| A | CHARGING STATION |
| B | EXPOSURE STATION |
| C | DEVELOPMENT AND TONER SUPPLYING STATION |
| D | TRANSFER STATION |
| E | DETACK STATION |
| F | FUSING STATION |
| G | CLEANING STATION |

SYSTEMS AND METHODS FOR MONITORING A FUSER CLEANING WEB

BACKGROUND AND SUMMARY

The disclosed embodiments relate generally to an improvement for a xerographic fusing system and, more particularly, to a fuser cleaning system in which the error associated with detecting a web related event (such as a web low event) is minimized.

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is cleaned and prepared to be used once again for the reproduction of a copy of an original. The paper with the powdered toner thereon in imagewise configuration is separated from the photoreceptor and moved through a fuser apparatus to permanently fix or fuse the toner image to the paper.

Typically, a fuser apparatus of the type referred to immediately above may provide a combination of heat and pressure to fix the toner image on the paper. The basic architecture of a fuser apparatus is well known. One commonly available fusing system comprises a pressure roll in contact with a rotatable heated fuser roll to form a nip between the pressure roll and the fuser roll. A sheet of paper carrying an unfused or powder toner image is passed through the nip. The side of the paper having the unfused or powder toner image typically faces the fuser roll, which is often supplied with a heat source, such as a resistance heater at the core of the fuser roll. The combination of heat from the fuser roll and pressure between the fuser roll and the pressure roll fuses the toner image to the paper, and once the fused toner cools, the image is permanently fixed to the paper.

In several known fusing systems there is provided a system by which the fuser roll can be automatically cleaned and/or supplied with a lubricant or release agent. For example, U.S. Pat. No. 6,876,832 to Pirwitz et al. discloses a fuser for an electrophotographic printer or copier with a fuser roll and pressure roll that form a nip through which a recording paper having a toner image is passed to fuse the toner image thereon. The fuser includes a cleaning web system to clean the fuser roll having a web supply roll, a tension roll to press the web against the fuser roll, and a web take up roll.

Keeping track of web usage or take up is a challenge due to the need for constant linear speed with an ever changing take up spool diameter. Tracking some aspect of an associated motor (such as counting motor steps), or mechanically sensing an amount of remaining web from supply spool diameter have each been used to gage web usage. For instance, in U.S. Pat. No. 5,049,944 to Debolt et al., the pertinent portions of which are incorporated herein by reference, a controller is used to monitor the depletion of a web by keeping track of the time the motor is running and a machine operator is advised, via an appropriate code on a display panel, when the supply of impregnated web material on the supply roll is becoming exhausted.

It is understood that various web-tracking approaches can be subject to error due to such factors as web media stretch, web material thickness variation or mechanical tolerance (between a mechanical sensing device and the supply roll). To allow for these errors, the web low event may be moved well ahead of the web out event to prevent cases where the web is completely consumed and tears off of the supply roll. As a result of moving the web low event ahead, however, extra material may be left on the spool at time of replacement, thus raising run costs due to waste.

In accordance with one aspect of disclosed embodiments there is disclosed an improved fusing system for use with a printing apparatus. The improved fusing system including a fuser roll; a take-up roll and a source roll, each one of said take-up roll and said source roll being movable; a strip of flexible material for at least one of cleaning and oiling said fuser roll, the strip of flexible material including a first portion, a second portion and a third portion, each one of the first, second and third portions having a first side and a second side; wherein the first portion is disposed adjacent the take-up roll, the second portion is initially disposed adjacent the source roll, and the third portion, which is disposed intermediate of the first portion and the second portion, is taken up by said take-up roll as both said take-up roll and said source roll are moved, and wherein the first side of the third portion contacts a portion of the fuser roll for achieving said at least one of cleaning and oiling; a detectable mark positioned on the first side of the second portion; a sensor positioned adjacent the first side of said strip of flexible material; a controller communicating with said sensor; and wherein when a substantial amount of the third portion has been taken up by the take-up roll, said detectable mark is detected by said sensor and a signal is transmitted from said sensor to said controller for indicating that the substantial amount of the third portion has been taken up by said take-up roll.

In accordance with another aspect of the disclosed embodiment there is disclosed a fuser cleaning system for use with a printing apparatus having a fuser with the fuser including a fuser roll. The fuser cleaning system includes a container for insertion into the printing apparatus, said container, when inserted into the printing apparatus, being positioned adjacent the fuser roll; a first roll and a second roll, each one of the first and second rolls being mounted within said container and being individually movable; a strip of flexible material for at least one of cleaning and oiling the fuser roll, the strip of flexible material including a first portion, a second portion and a third portion, each one of the first, second and third portions having a first side and a second side; wherein the first portion is initially disposed adjacent said first roll, the second portion is initially disposed adjacent said second roll, and the third portion, which is disposed intermediate of said first and second portions, is taken up by said first roll as the first and second rolls are moved, and wherein the first side of the third portion contacts a portion of the fuser roll for achieving said at least one of cleaning and oiling; and a detectable mark positioned in the first side of the second portion in such a manner that when said container is inserted into the printing apparatus and a substantial amount of the third portion has been taken up by said first roll, said detectable mark is detected by a sensor and a signal is transmitted from the sensor to a controller for indicating that the substantial amount of the third portion has been taken up by the first roll.

In accordance with yet another aspect of the disclosed embodiments there is disclosed a fuser cleaning system for use with a printing apparatus having a fuser with the fuser including a fuser roll. The fuser cleaning system includes a first roll and a second roll, each one of the first and second rolls being individually movable; a strip of flexible material for at least one of cleaning and oiling the fuser roll, the strip of flexible material including a first portion, a second portion and a third portion, each one of the first, second and third portions having a first side and a second side; wherein the first portion is initially disposed adjacent said first roll, the second portion is initially disposed adjacent said second roll, and the third portion, which is disposed intermediate of the first and second portions, is taken up by said first roll as said first and second rolls are moved, and wherein the first side of the third portion contacts a portion of the fuser roll for achieving said at least one of cleaning and oiling; a first detectable mark positioned in the first side of the second portion and a second detectable mark disposed intermediate of the first detectable mark and an end of the strip of flexible material; and wherein, in a first mode, when said first detectable mark is detected by a sensor, a signal is transmitted from the sensor to a controller indicating that the substantial amount of the third portion has been taken up by said first roll, and wherein, in a second mode, when said second detectable mark is detected by the sensor, a signal is transmitted from the sensor to the controller indicating that substantially all of the third portion has been taken up by said first roll.

In accordance with another aspect of the disclosed embodiments there is disclosed a method of controlling a system for cleaning and oiling a fuser roll. The method includes: providing a strip of flexible material for at least one of cleaning and oiling the fuser roll, the strip of flexible material including a first portion, a second portion and a third portion, each one of the first, second and third portions having a first side and a second side; initially disposing the first portion adjacent a first movable roll; initially disposing the second portion adjacent a second movable roll; disposing the third portion intermediate of the first and second portions so that the third portion is taken up by the first movable roll as the first and second movable rolls are moved, wherein the first side of the third portion contacts a portion of the fuser roll for achieving said at least one of cleaning and oiling; positioning a first detectable mark in the first side of the second portion; positioning a second detectable mark in the first side of the second portion intermediate of the first detectable mark and an end of the strip of flexible material; in a first mode, detecting the first detectable mark with a sensor and transmitting a first signal from the sensor to a controller indicating that a substantial amount of the third portion has been taken up by the first movable roll; and in a second mode, detecting the second detectable mark with the sensor and transmitting a second signal from the sensor to the controller indicating that substantially all of the third portion has been taken up by the first movable roll.

DESCRIPTION OF DISCLOSED EMBODIMENTS

Figure 1:
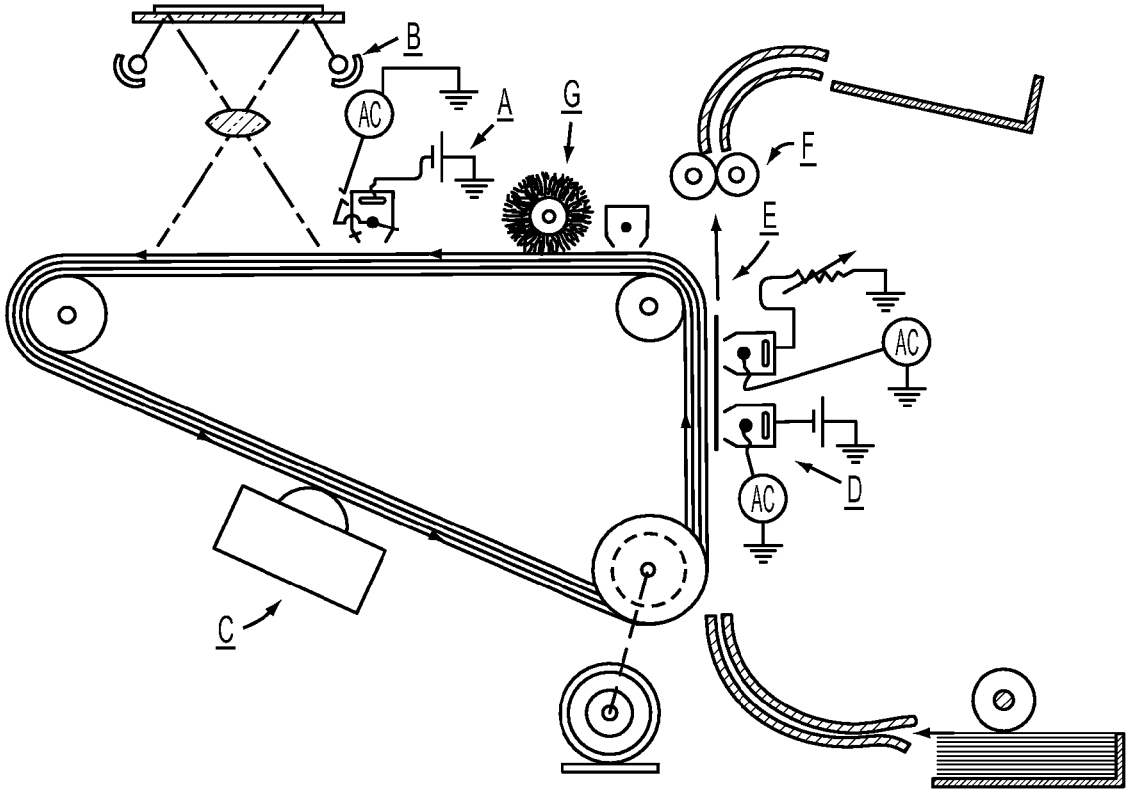
FIG. 1 is a schematic, planar view of a xerographic printing system.

Referring now to FIG. 1 a xerographic printing system in which the disclosed embodiments may be employed is shown. The printing system of FIG. 1 includes a charge station A, an expose station B, a development and toner supplying station C, a paper transfer station D, a detack station E, a fuser station F, and a cleaning station G. As will appear, the improvement of the disclosed embodiments finds particular use with fuser station F. Details regarding operation of the illustrated printing system, which is well known, may be understood by reference to U.S. Pat. No. 4,804,999 to Mueller, the pertinent portions of which are incorporated herein by reference.

Figure 2:
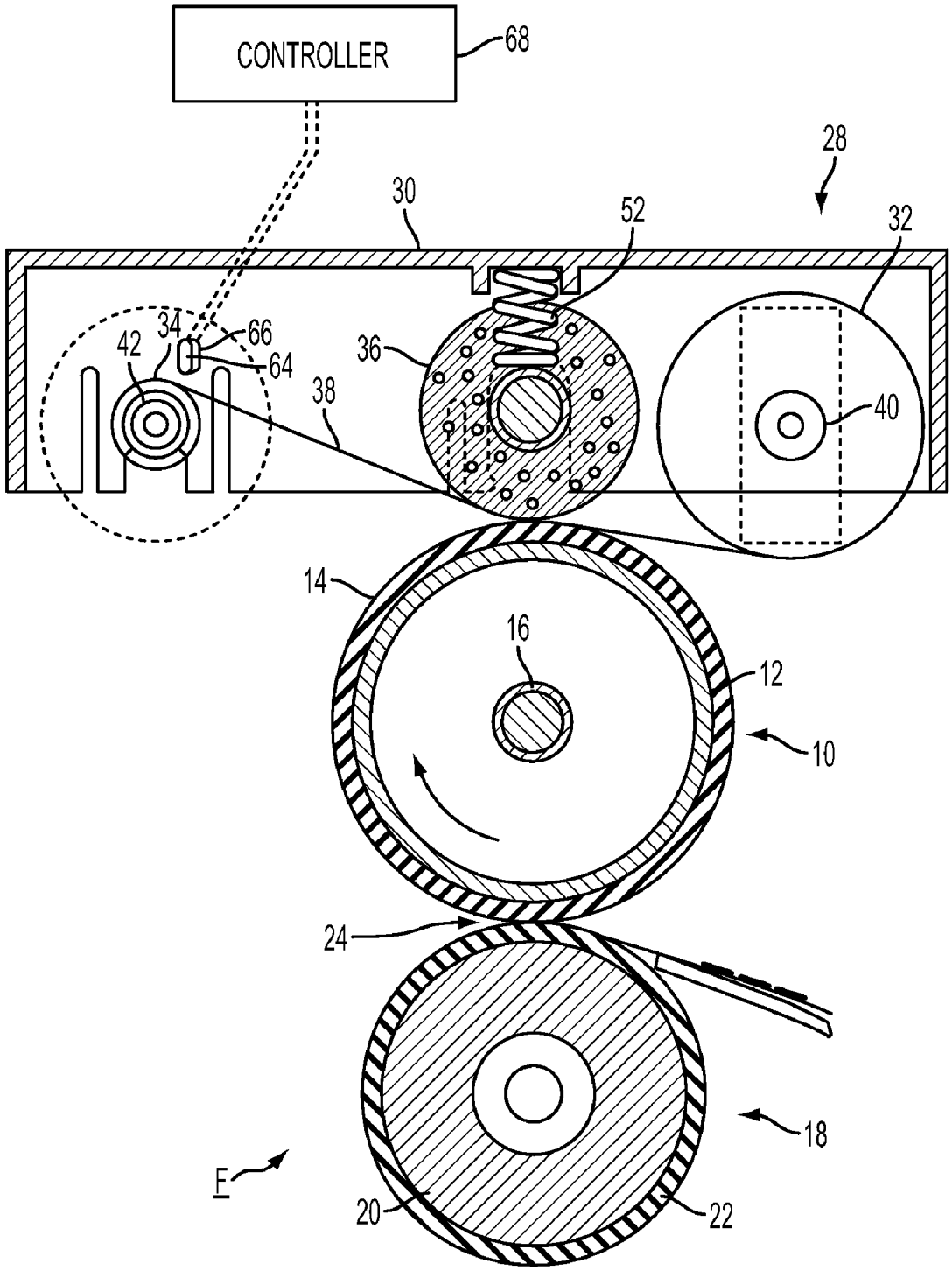
FIG. 2 is a planar, cross-sectional view of a fuser with a fuser cleaning system, the fuser cleaning system being improved in accordance with the disclosure below.
Figure 3:
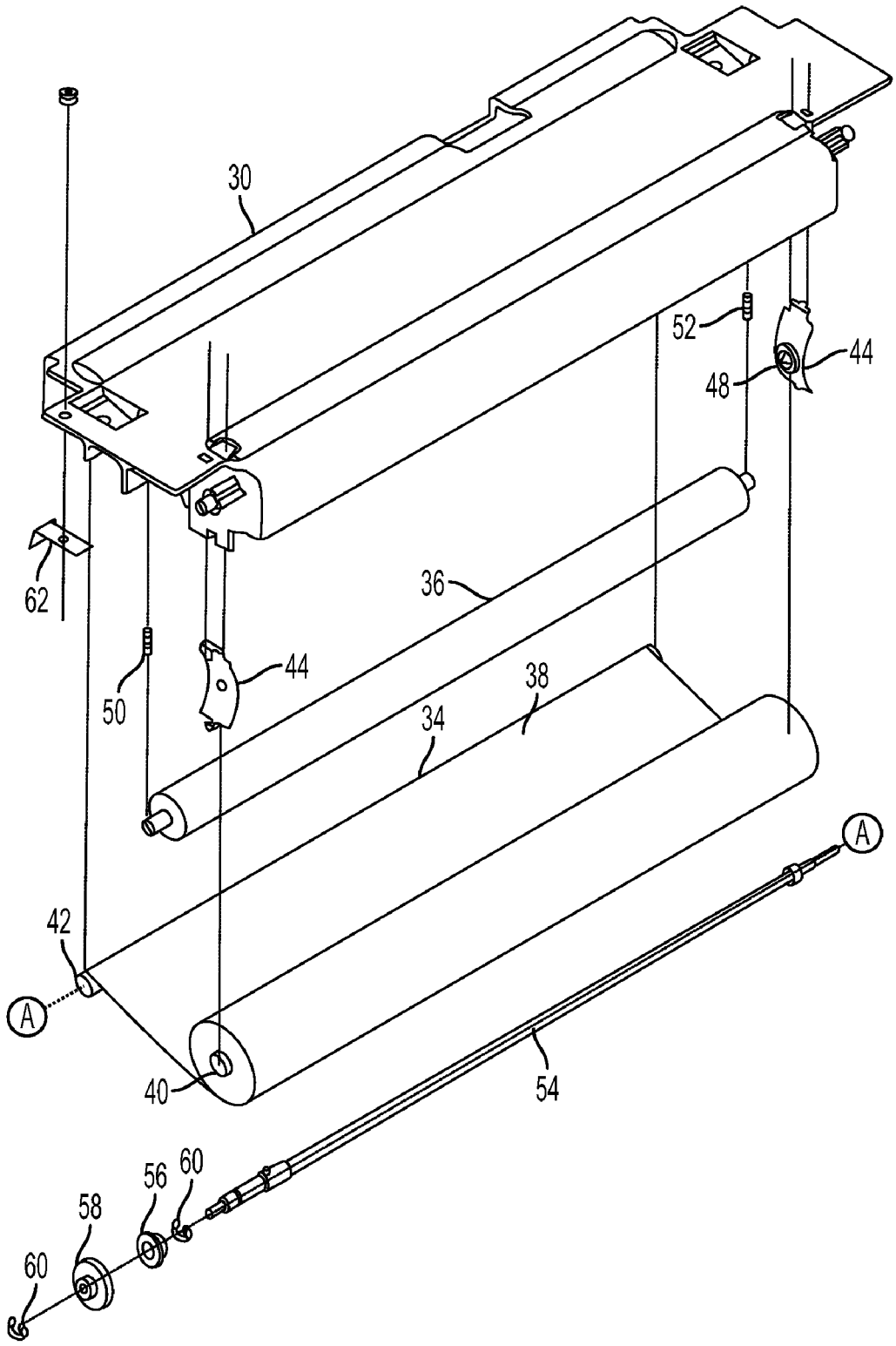
FIG. 3 is a partial exploded isometric view of the fuser cleaning system of FIG. 2.

Referring to FIGS. 2 and 3, a contemplated embodiment for the fuser station F is described. As shown in FIG. 2, the fuser station F includes a roll 10 composed of a core 12 having coated thereon a thin elastomeric layer 14. The core 12 may be made of various metals such as iron, aluminum, nickel, stainless steel, etc., and various synthetic resins. Aluminum is preferred as the material for the core 12, although this is not critical. The core 12 is hollow and a heating element 16 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the disclosed embodiments, and the fuser member can be heated by internal means, external means or a combination of both. All heating means are well known in the art for providing sufficient heat to fuse the toner to the support. The thin fusing elastomer layer 14 may be made of any of the well known materials such as the RTV and HTV silicone elastomers.

The fuser roll 10 is shown in a pressure contact arrangement with a backup or pressure roll 18, the pressure roll comprising a metal core 20 with a layer 22 of heat-resistant material. In this assembly, both the fuser roll 10 and the pressure roll 18 are mounted on bearings (not shown) which are biased so that the fuser roll 10 and pressure roll 18 are pressed against each other under sufficient pressure to form a nip 24. It is in this nip that the fusing or fixing action takes place. The layer 22 may be made of any of the well known materials such as fluorinated ethylene propylene copolymer or silicone rubber.

A liquid release agent delivery system or release agent management system (also referred to herein as "fuser cleaning system"), designated by the numeral 28, includes a housing 30 which may typically be a one-piece plastic molded member having mounting elements such as slots or holes for each of a web supply roll 32, the web take-up roll 34 and the open celled foam pinch roll 36. The web supply roll 32 and web take-up roll 34 are supported in the housing such that when a liquid release agent delivery system is in place, one of the supply roll 32 and take-up rolls 34 is on one side of the fuser roll 10 and the other is on the other side of the fuser roll, and a movable web 38 is in contact with the fuser roll 10 along a path parallel to its longitudinal axis. In addition, the movable web 38 is urged into delivery engagement with the fuser roll by the open celled foam pinch roll 36 positioned on the side of the web 38 opposite the fuser roll 10. As will be appreciated by those skilled in the art, the housing 30 may comprise a self-contained replaceable unit, as shown in U.S. Pat. No. 5,049,944 to DeBolt et al. That is, the unit might be removably mounted, relative to the fuser station F. In this way the unit can be replaced with a new unit once the movable web 38 has been taken up by the take-up roll 34.

The supply roll 32 and take-up roll 34 are each made from interchangeable rotatable tubular support cores 40 and 42 to enable the reversibility of the web. The supply roll core 40 has a supply of release agent impregnated web material 38 wound around the core and is tensioned within the housing to resist unwinding by means of a leaf spring 44 at each end of the housing 30 which urges the mounting collars 48 into engagement with the rotatable tubular support core 40. The foam pinch roll 36 which is also impregnated with liquid release agent is spring biased toward the fuser roll by two coil springs 50 and 52, one at each end of a pinch roll mounting slot to apply pressure between the web 38 and the fuser roll 10 to insure delivery of an adequate quantity of release agent to the fuser roll. The pinch roll 36 is impregnated with release agent which insures that any sections of the web material which may have been loaded with inadequate quantities of release agent are supplied with release agent.

The take-up roll 34 is mounted on a drive shaft 54 to advance the impregnated web from the supply roll 32 to the take-up roll. The driven end of the drive shaft includes a bearing 56, gear 58 and two retaining rings 60 and is driven by a dedicated motor such as an AC synchronous gear motor or clock motor. The housing has an anti-rotation clip 62 which engages the drive gear 58 on the drive shaft 54 to prevent the take-up roll shaft 54 from unwinding. The supply roll is mounted in two mounting collars 48 one on each end of the housing which are on leaf spring 44. The take-up roll has one end of the drive shaft mounted in a hole in the housing and the other drive gear end mounted in a snap fitted slot in the housing. Similarly, the pinch roll shaft is mounted in two slots.

Referring specifically to FIG. 2, sensors 64 ("sensor 1") and 66 ("sensor 2"), the significance of which will appear, are positioned near take-up roll 34. The sensors may communicate with a machine controller 68. As contemplated, the machine controller may comprise a known programmable controller or combination of controllers, the controller(s) conventionally controlling all the machine steps and functions described above. In the disclosed embodiments, the machine controller 68 is responsive to a variety of sensing devices for enhancing control of the machine, and providing connection diagnostic operations to an user interface (not shown) where required. The controller may be programmed to cause release agent to be delivered to the fuser roll at a substantially constant rate up to a predetermined number of prints in a print run.

As discussed in U.S. Pat. No. 5,049,944, the movable web supply roll and take-up roll may be reversibly mounted in the housing 30 to deliver liquid release agent and when the supply of web material has or is about to become exhausted the position of the supply roll and take-up roll may be reversed so that the second side of the impregnated web is in contact with the fuser roll to deliver release agent thereto. This is facilitated by having interchangeable rotatable tubular support cores for each of the supply roll and the take-up roll which may be manually removed from the mounting, flipped over and reinserted in their reversed positions.

When the supply of impregnated web on the new supply roll (the take-up roll on the first side of the impregnated web) is or is about to be exhausted the supply roll web and take-up roll are removed and replaced with a new supply roll impregnated web and take-up roll which may be used in the same manner wherein initially a first side of the impregnated web is in contact with the fuser roll, its supply exhausted, the web is reversed and the second side of the impregnated web is placed in contact with the fuser roll to deliver release agent to it. During this process, it should be noted that the level of release agent in the open celled foam pinch roll is generally in equilibrium in that while the impregnated web delivers release agent to the fuser roll on one side the other side is in contact with the foam roll and resupplies release agent to it.

Figure 4:
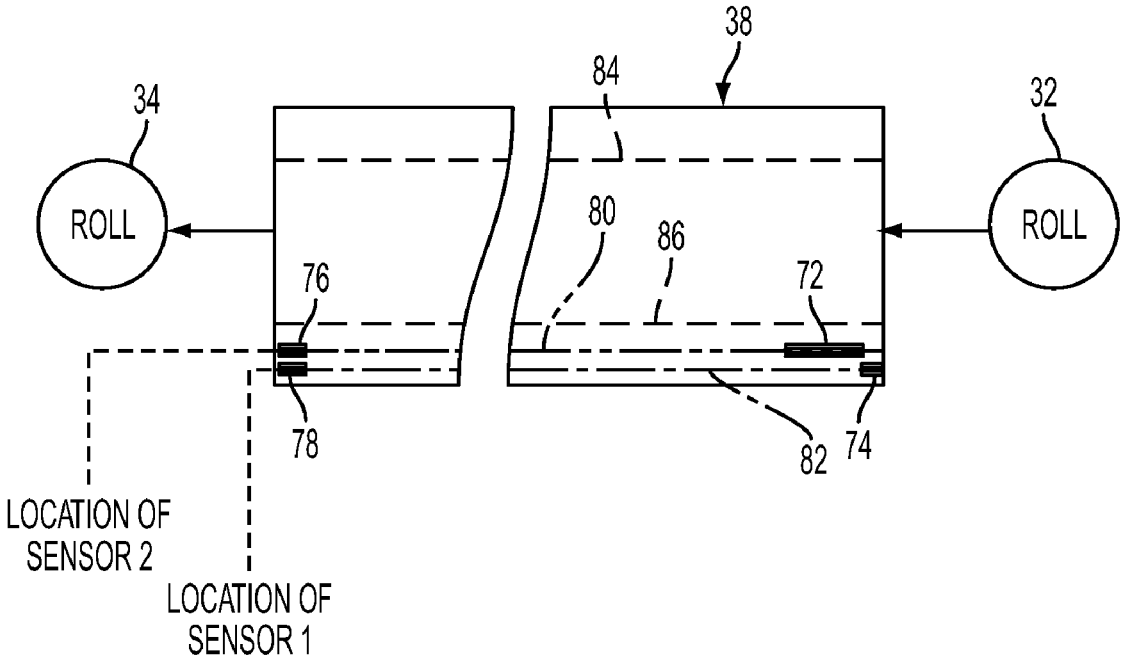
FIG. 4 is a planar view of a cleaning web (or flexible material strip) suitable for use in the presently disclosed improved fuser cleaning system.

Referring now to FIG. 4, an improved approach for determining at least three states or levels of the web, namely "web low," "web out," and "web start," is shown. More particularly, web usage may be flagged at two levels: "web low" and "web out". The web low warning gives a customer adequate warning to finish a job or call service depending on whether the web is customer replaceable or not. The web out warning, in one example of operation, forces a shut down to prevent restart until the web has been replaced. By placing a detectable mark or stripe 72 on the web at a known distance from the end of material, the number of prints or hours remaining can be more accurately calculated, with web stretch being the only variable. By placing a second detectable stripe 74 adjacent to the first but much closer to the end of web, an exact determination of the web out event can be readily ascertained. In addition, by placing two stripes 76 and 78 side by side at the start of the web, three distinct new web states can be detected.

More particularly, sensor 1 and sensor 2 are positioned to detect the stripes 72, 74, 76 and 78 as they pass by the sensors. As the stripes are detected, corresponding signals are transmitted to the machine controller 68. In turn, the machine controller can perform preprogrammed functions, such as sending a coded message to a user interface (not shown) to indicate that a web low level has been detected, or shutting down the liquid release agent delivery system when a web out level is detected. Moreover, stripes 72, 74, 76, and 78 may desirably be placed along the inboard or outboard marginal edge portions of the web 38 (designated as portions 84 and 86 in FIG. 4) so as to avoid contact or smearing with the release agent. Finally, the pattern of stripes 72, 74, 76, 78 can be positioned on both sides of movable web 38 in such a manner that the web can, after being taken up on one side, be reversed for use on the other side. Of course, the stripe pairing 72, 74 and the stripe pairing 76, 78 would assume one configuration (relative to one of the ends of web 38) on one side and another (or reversed) configuration on the other side.

The following summarizes the functionality of the web stripes:

(1) Stripes or marks 76, 78 are placed at the start of web 38 so both sensors will be actuated as stripes 76, 78 pass thereby. This is the indication that the web is new so that a suitable algorithm for controlling web speed (possibly one of the web speed control algorithms used in Xerox's iGen3 or iGen4 digital production press ["iGen3" and "iGen4" are trademarks of Xerox Corporation]) and one or more high frequency service item(s) [HFSI] counters can be reset.

(2) Stripe 72 is placed along an axis 80 (common with stripe 76) a fixed distance from an end of web 38 to signal the web low level when stripe 72 is detected by sensor 2. Responsive to stripe 72 being detected by sensor 2, the speed control algorithm can be checked and, if necessary, adjusted to reflect the exact amount of web remaining.

(3) Stripe 74 is placed along an axis 82 (common with stripe 78) at the end of web 38 to signal when strip 74 is detected by sensor 1. Responsive to stripe 74 being detected by sensor 1, the web out warning may be displayed and the machine (or at least the liquid release agent delivery system) shut down until a new web can be installed.

(4) Stripes 72, 74, 76 and 78 do not need to be very long since the web material typically advances quite slowly. Moreover, since each stripe has some thickness, minimizing stripe length serves to avoid bulging and tracking problems with the roll.

In one exemplary implementation, the stripes are opaque (relative to the web) and the sensors are optical based sensors. It will be appreciated by those skilled in the art, however, that many other sensing configurations could be used without changing the principles upon which the disclosed embodiments are based. In another exemplary implementation, the stripes could be composed of magnetic based material, in which case the sensors would be magnetic based. In yet another exemplary embodiment, the stripes could be composed of conductive based material, in which case the sensors would be conductive based, and might actually detect the stripes through contact with the web.

It should now be apparent that the above-disclosed sensing system addresses several challenges associated with the prior art. For one, the disclosed sensing arrangement allows for multi-mode sensing along a liquid impregnated web. That is, by using multiple stripes in conjunction with multiple sensors, a variety of states or levels associated with the web can be ascertained. For another, the sensing system permits highly accurate determination of web low and web out states. In particular, a user can know where a specific portion of the web is relative to the end of the web, notwithstanding the speed or consistency with which the web has been taken up. For yet another, the simplicity of the disclosed system makes it easy to implement reliably in several different configurations—optical, magnetic and conductive based approaches, among others, can be used.

Based on the above description, the following should now be apparent from the disclosure above:

There is disclosed an improved fuser cleaning system in which a strip of flexible material (or web), including first second and third portions, is fed from a source roll to a take-up roll in such a manner that a fuser roll is cleaned or oiled. A first detectable mark may be disposed on either side of the strip of flexible material in one of the first and second portions. During operation of the fuser cleaning system, the third portion is taken up by the take-up roll and when an amount of the third portion is taken up by the take-up roll, the first detectable mark is detected by a sensor and a signal, indicating that the amount of the third portion has been taken up by the take-up roll, is transmitted to a controller. As contemplated, the strip of flexible material or web has two sides and a first detectable mark may be positioned on both sides of the web so that a web low event can be detected whether the cleaning/oiling is being performed on one side or the other.

The first detectable mark may be spaced from an end of the strip of flexible material. A second detectable mark may be disposed on the side of the strip of flexible material with the first detectable mark. When substantially all of the third portion has been taken up by the take-up roll, the second detectable mark is detected and a signal is transmitted from the sensor to the controller indicating that substantially all of the third portion has been taken up by the take-up roll. Responsive to the controller receiving the signal indicating that substantially all of the third portion has been taken up by the take-up roll, the fuser cleaning system may be shut down.

The first detectable mark and the second detectable mark may be respectively disposed along a first axis and a second axis, wherein the first axis is substantially parallel to the second axis. A third detectable mark may be disposed in the side of the first portion along one of the first and second axes so that when the first portion is taken up by the take-up roll, the third detectable mark is detected by the sensor and a startup signal for the strip of flexible material is transmitted to the controller. The detectable marks may be configured so as to be detectable by one of: (a) an optical sensor, (b) a magnetic impulse sensor, and (c) a conductive based sensor.

The claims, as originally presented and as possibly amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An improved fusing system for a printing apparatus, the system comprising:

a fuser roll;

a take-up roll and a source roll, each one of the take-up roll and the source roll being movable;

a strip of flexible material for at least one of cleaning and oiling the fuser roll, the strip of flexible material including a first portion, a second portion and a third portion, each one of the first, second and third portions having a first side and a second side;

wherein the first portion is disposed adjacent the take-up roll, the second portion is initially disposed adjacent the source roll, and the third portion, which is disposed intermediate of the first portion and the second portion, is taken up by the take-up roll as both the take-up roll and the source roll are moved, and wherein the first side of the third portion contacts a portion of the fuser roll for achieving the at least one of cleaning and oiling;

a first detectable mark positioned on the first side of the second portion;

a first sensor positioned adjacent the first side of the strip of flexible material, the first sensor being configured to output a first signal indicating that a substantial amount of the third portion has been taken up by the take-up roll when the first sensor detects the first detectable mark;

a second detectable mark in the first side of the second portion; and a second sensor positioned adjacent the first side of said strip of flexible material, the second sensor being configured to output a second signal indicating that substantially all of the third portion has been taken up by the first roll when the second sensor detects the second detectable mark.

2. The improved fusing system of claim 1, the system further comprising:

a controller that shuts down the fusing system in response to receiving the second signal.

3. The improved fusing system of claim 1, in which the first detectable mark and the second detectable mark are respectively disposed along a first axis and a second axis, wherein the first axis is substantially parallel to the second axis, the first axis and the second axis extending longitudinally along the strip of flexible material.

4. The improved fusing system of claim 1, in which the strip of flexible material includes marginal edge portions, wherein the first and second detectable marks are substantially disposed in one of the marginal edge portions.

5. The improved fusing system of claim 1, wherein at least one of the first sensor and the second sensor is one of (a) an optical sensor, (b) a magnetic impulse sensor, and (c) a conductive based sensor.

6. A fuser cleaning system for use with a printing apparatus having a fuser with the fuser including a fuser roll, comprising:

a container for insertion into the printing apparatus, the container being positioned adjacent the fuser roll when inserted into the printing apparatus;

a first roll and a second roll, each one of the first and the second rolls being mounted within the container and being individually movable;

a strip of flexible material for at least one of cleaning and oiling the fuser roll, the strip of flexible material including a first portion, a second portion and a third portion, each one of the first, the second and the third portions having a first side and a second side;

wherein the first portion is initially disposed adjacent the first roll, the second portion is initially disposed adjacent the second roll, and the third portion, which is disposed intermediate of the first and the second portions, is taken up by the first roll as the first and the second rolls are moved, and wherein the first side of the third portion contacts a portion of the fuser roll for achieving the at least one of cleaning and oiling; and a first detectable mark positioned in the first side of the second portion in such a manner that when the container is inserted into the printing apparatus and a substantial amount of the third portion has been taken up by said first roll, the first detectable mark is detected by a first sensor and a first signal is transmitted from the first sensor to a controller for indicating that the substantial amount of the third portion has been taken up by the first roll, wherein the second portion includes an end of said strip of flexible material, the first detectable mark being spaced from the end of the strip of flexible material;

a second detectable mark disposed intermediate of the first detectable mark and the end of the strip of flexible material; and a second sensor disposed adjacent to the first sensor, the second sensor being configured to transmit a second signal indicating that substantially all of the third portion has been taken up by the first roll.

7. The fuser cleaning system of claim 6, further comprising a controller that shuts down the fuser cleaning system in response to receiving the second signal.

8. The fuser cleaning system of claim 6, wherein the first detectable mark and the second detectable mark are respectively disposed along a first axis and a second axis, the first axis being substantially parallel to the second axis, the first axis and the second axis extending longitudinally along the strip of flexible material.

9. The fuser cleaning system of claim 8, further comprising:

a third detectable mark disposed in the first side of the first portion along one of the first axis and the second axis, the first sensor second sensor being respectively disposed along the first axis and the second axis, when the first portion is taken up by said first roll, the third detectable mark is detected by one of the first sensor and the second sensor and a startup signal for the strip of flexible material is transmitted to the controller, the one of the first sensor and the second sensor being actuated for detecting one of the first detectable mark and the second detectable mark.

10. The fuser cleaning system of claim 6, wherein at least one of the first detectable mark and the second detectable mark is configured to be detectable by one of: (a) an optical sensor, (b) a magnetic impulse sensor, and (c) a conductive based sensor.

11. A fuser cleaning system for use with a printing apparatus having a fuser with the fuser including a fuser roll, comprising:

a first roll and a second roll, each one of the first and the second rolls being individually movable;

a strip of flexible material for at least one of cleaning and oiling the fuser roll, the strip of flexible material including a first portion, a second portion and a third portion, each one of the first, second and third portions having a first side and a second side;

wherein the first portion is initially disposed adjacent said first roll, the second portion is initially disposed adjacent said second roll, and the third portion, which is disposed intermediate of the first and second portions, is taken up by said first roll as said first and second rolls are moved, and wherein the first side of the third portion contacts a portion of the fuser roll for achieving the at least one of cleaning and oiling;

a first detectable mark positioned in the first side of the second portion and a second detectable mark disposed intermediate of the first detectable mark and an end of the strip of flexible material; and wherein, in a first mode, when said first detectable mark is detected by a first sensor, a first signal is transmitted from the first sensor to a controller indicating that a substantial amount of the third portion has been taken up by the first roll, and wherein, in a second mode, when the second detectable mark is detected by a second sensor, a second signal is transmitted from the second sensor to the controller indicating that substantially all of the third portion has been taken up by said first roll.

12. The fuser cleaning system of claim 11, wherein, responsive to the controller receiving the second signal indicating that substantially all of the third portion has been taken up by said first roll, the fuser cleaning system is shut down.

13. The fuser cleaning system of claim 11, in which the first detectable mark and the second detectable mark are respectively disposed along a first axis and a second axis, wherein the first axis is substantially parallel to the second axis, wherein the first detectable mark has a thickness, and wherein the second detectable mark has a thickness.

14. The fuser cleaning system of claim 11, wherein each one of the first and the second detectable marks is configured so that it is detectable by one of: (a) an optical sensor, (b) a magnetic impulse sensor, and (c) a conductive based sensor.

15. The fuser cleaning system of claim 11, in which subsequent to substantially all of the third portion being taken up by the first roll, the first portion is initially disposed adjacent to the second roll, the second portion is initially disposed adjacent to the first roll, and the third portion, which is disposed intermediate of the first and the second rolls, is taken up by the second roll as the first and second rolls are moved, and in which the second side of the third portion contacts a portion of the fuser roll for achieving at the at least one of cleaning and oiling, further comprising a third detectable mark positioned in the second side of the first portion so that in a third mode, when substantially all of the third portion has been taken up by the second roll and the third detectable mark is detected by a sensor, a signal is transmitted from the sensor to the controller indicating that the substantial amount of the third portion has been taken up by the second roll.

16. A method of controlling a system for cleaning and oiling a fuser roll, comprising:

providing a strip of flexible material for at least one of cleaning and oiling the fuser roll, the strip of flexible material including a first portion, a second portion and a third portion, each one of the first, second and third portions having a first side and a second side;

initially disposing the first portion adjacent a first movable roll;

initially disposing the second portion adjacent a second movable roll;

disposing the third portion intermediate of the first and second portions so that the third portion is taken up by the first movable roll as the first and second movable rolls are moved, wherein the first side of the third portion contacts a portion of the fuser roll for achieving said at least one of cleaning and oiling;

positioning a first detectable mark in the first side of the second portion;

positioning a second detectable mark in the first side of the second portion intermediate of the first detectable mark and an end of the strip of flexible material; and in a first mode, detecting the first detectable mark with a first sensor and transmitting a first signal from the first sensor to a controller indicating that a substantial amount of the third portion has been taken up by the first movable roll;

in a second mode, detecting the second detectable mark with a second sensor and transmitting a second signal from the second sensor to the controller indicating that substantially all of the third portion has been taken up by the first movable roll.

17. The method of claim 16, further comprising shutting down the system responsive to the controller receiving the second signal indicating that substantially all of the third portion has been taken up by the first movable roll.

18. The method of claim 16, further comprising respectively disposing the first detectable mark and the second detectable mark along a first axis and a second axis, respectively, wherein the first axis is substantially parallel to the second axis.

19. The method of claim 16, wherein each one of the first and the second detectable marks is configured to be detectable by one of: (a) an optical sensor, (b) a magnetic impulse sensor, and (c) a conductive based sensor.

20. The method of claim 16, in which subsequent to substantially all of the third portion being taken up by the first roll, the first portion is initially disposed adjacent to the second roll, the second portion is initially disposed adjacent to the first roll, and the third portion, which is disposed intermediate of the first and second rolls, is taken up by the second roll as the first and second rolls are moved, and in which the second side of the third portion contacts a portion of the fuser roll for achieving the at least one of cleaning and oiling, further comprising positioning a third detectable mark in the second side of the first portion so that in a third mode, when substantially all of the third portion has been taken up by the second roll and the third detectable mark is detected by a sensor, a signal is transmitted from the sensor to the controller indicating that the substantial amount of the third portion has been taken up by the second roll.

* * * * *